US006830131B2

(12) United States Patent
Mustalahti et al.

(10) Patent No.: US 6,830,131 B2
(45) Date of Patent: Dec. 14, 2004

(54) ELEVATOR HOISTING MACHINE

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/084,373

(22) Filed: Feb. 28, 2002

(65) Prior Publication Data

US 2002/0108815 A1 Aug. 15, 2002

Related U.S. Application Data

(63) Continuation of application No. PCT/FI00/00784, filed on Sep. 15, 2000.

(30) Foreign Application Priority Data

Sep. 16, 1999 (FI) ..... 19991975

(51) Int. Cl.[7] ..... B66B 11/08
(52) U.S. Cl. ..... 187/254; 187/406; 188/77 R
(58) Field of Search ..... 187/254, 266, 187/250, 292, 406, 251, 414; 310/91, 51, 268; 188/184, 185, 186, 77 R, 77 W

(56) References Cited

U.S. PATENT DOCUMENTS 2,088,690 A * 8/1937 Crispen ..... 187/254
3,101,130 A * 8/1963 Bianco ..... 187/244
3,500,083 A * 3/1970 Dochterman ..... 310/51
4,664,230 A * 5/1987 Olsen ..... 187/255
4,739,969 A * 4/1988 Eckersley et al. ..... 187/261
5,018,603 A * 5/1991 Ito ..... 187/254
5,144,183 A * 9/1992 Farrenkopf ..... 310/268
5,153,389 A * 10/1992 Nomura ..... 187/288
5,589,722 A * 12/1996 Sakaguchi et al. ..... 310/180
5,783,895 A * 7/1998 Hakala et al. ..... 310/268
5,899,301 A * 5/1999 Aulanko et al. ..... 187/266
5,906,251 A * 5/1999 Aulanko et al. ..... 187/254
5,962,948 A * 10/1999 Hakala et al. ..... 310/268
5,971,109 A * 10/1999 Aulanko et al. ..... 187/263
5,982,060 A * 11/1999 Hakala et al. ..... 310/268
5,996,742 A * 12/1999 Aulanko et al. ..... 187/254
6,006,865 A * 12/1999 Ammon ..... 187/266
6,021,872 A * 2/2000 Sevilleja et al. ..... 187/166
6,260,673 B1 * 7/2001 Mustalahti ..... 187/288
6,374,964 B2 * 4/2002 Mustalahti et al. ..... 188/186
6,401,873 B1 * 6/2002 Mustalahti et al. ..... 187/292

FOREIGN PATENT DOCUMENTS

EP 0 688 735 A2 12/1995
FI WO 01/19715 * 3/2001
JP 2000318957 * 11/2000

* cited by examiner

*Primary Examiner*—Paul T. Chin
(74) *Attorney, Agent, or Firm*—Birch, Stewart, Kolasch & Birch, LLP

(57) ABSTRACT

A hoisting machine for an elevator, mounted on and fastened to one side of an elevator or counterweight guide rail. The machine comprises at least an elevator motor and a traction sheave driving the elevator ropes, and two operating brakes of the elevator. The hoisting machine is fastened to the guide rail via the operating brakes or by a point in the immediate vicinity of the operating brakes.

6 Claims, 3 Drawing Sheets

ELEVATOR HOISTING MACHINE

This application is a Continuation of copending PCT International Application No. PCT/FI00/00784 filed on Sep. 15, 2000, which was published in English and which designated the United States and on which priority is claimed under 35 U.S.C. § 120, the entire contents of which are hereby incorporated by reference.

FIELD OF THE INVENTION

The present invention relates to an elevator hoisting machine for an elevator mounted on and fastened to one side of an elevator or counterweight guide rail.

DESCRIPTION OF THE BACKGROUND ART

Prior-art technology in the field of the invention is described in patent specification EP 0688735 A2. This specification presents a flat overall solution for use in elevators, which is so mounted in the hoistway that no separate machine rooms are needed. A hoisting machine is mounted on a guide rail in the hoistway, either a car guide rail or a counterweight guide rail, either directly or using a suitable auxiliary frame. Such a hoisting machine allows an arrangement of the various elevator structures that is very advantageous in respect of space utilization as regards the building as a whole as well as the elevator itself.

Such a hoisting machine is relatively noiseless and free of vibrations when operated at low speeds. However, when the traveling speed is increased, sooner or later a speed range will be reached where, due to the cyclic nature of the field variations occurring in the electric motor, the excitation frequency generated by the motor is of the same order as the natural vibration frequency of the stator frame of the machine. Therefore, the forces acting between the rotor and the stator may cause vibrations in the stator frame that are sufficient to produce noises of a disturbing intensity in the hoistway, elevator car as well as outside the hoistway. In flat hoisting machines placed in the hoistway, the brakes, which are mounted on the sides of the machine frame, act as mass concentrations which, together with the frame, constitute in the hoisting machine a subsystem having relatively low natural vibration frequencies. When it is required that the elevator provide a high level of traveling comfort and produce a low level of airborne noise and a low oscillation level of structure-borne noise radiating from the elevator to the building, the question of controlling the lowest range of natural frequencies of the hoisting machine becomes very important because these are likely to determine the maximum disturbance-free velocity that can be used. Making the machine frame more rigid would easily lead to an undesirable increase in the weight and size of the machine.

Traditionally, the vibrations and noise produced by the elevator hoisting machine have been relatively easily eliminated to a sufficient degree by improving sound insulation in separate machine rooms and by mounting the machine on a bed provided with vibration insulation. However, when the hoisting machine is placed in the hoistway, there is no space around it that would allow the provision of any significant sound insulation or arrangements for damping sound propagation in the structures. Consequently, instead of noise abatement, the hoisting machine itself has to be structurally so designed that it will work quietly enough not to disturb passengers in the car or people in the vicinity of the hoistway in the building.

BRIEF SUMMARY OF THE INVENTION

Thus, the object of the invention is to disclose a flat elevator hoisting machine, in other words, an elevator hoisting machine having a relatively short dimension in the direction of the axis of the traction sheave, a machine which has a low level of noise and vibration, i.e. a machine which, regardless of the car speed, produces as little vibration and noise effects in the hoistway, in the car and outside the hoistway as possible. A further object of the invention is to disclose a flat elevator hoisting machine which, in spite of vibration-free and noiseless operation, still requires but extremely little space in the hoistway and is therefore easy to install in the hoistway. Another object of the invention is to improve the hoisting machine concept known from specification EP 0688735 A2.

An elevator hoisting machine mounted on the side of an elevator guide rail or a counterweight guide rail makes it possible to build an elevator without a machine room that provides significant advantages regarding structural aspects and space utilization.

As the hoisting machine is fixed to the guide rail via the operating brakes or by a point in the immediate vicinity of the operating brakes, the guide rail functions as an additional reinforcement of the machine frame of the hoisting machine in a particularly favorable manner. The lowest natural vibrations of the machine are generated as the heavy brakes supported by the relatively wide machine frame are vibrating. The frequency of this vibration can be increased by stiffening the frame so as to provide more resistance to the vibration of the brakes. By making use of the elevator guide rail to obtain additional reinforcement, separate measures increasing the weight and/or thickness of the machine are avoided. Or if the level of vibration and noise is satisfactory, then the selective additional stiffness provided by the guide rail may even allow the use of a lighter hoisting machine frame.

Placing the brakes at the upper and lower edges of the machine provides the additional advantage that the hoisting machine is also narrow besides being flat, thus allowing the machine to be installed even in a very narrow hoistway, making it excellently applicable for use in repair and modernization construction projects.

Mounting the shaft of the traction sheave on the guide rail increases the stiffness of the structure or alternatively allows lighter suspension of the shaft on the frame of the hoisting machine.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described with reference to the drawings, which are given by way of illustration only, and thus are not limitative of the present invention, and wherein.

DETAILED DESCRIPTION OF THE INVENTION

Figure 1:
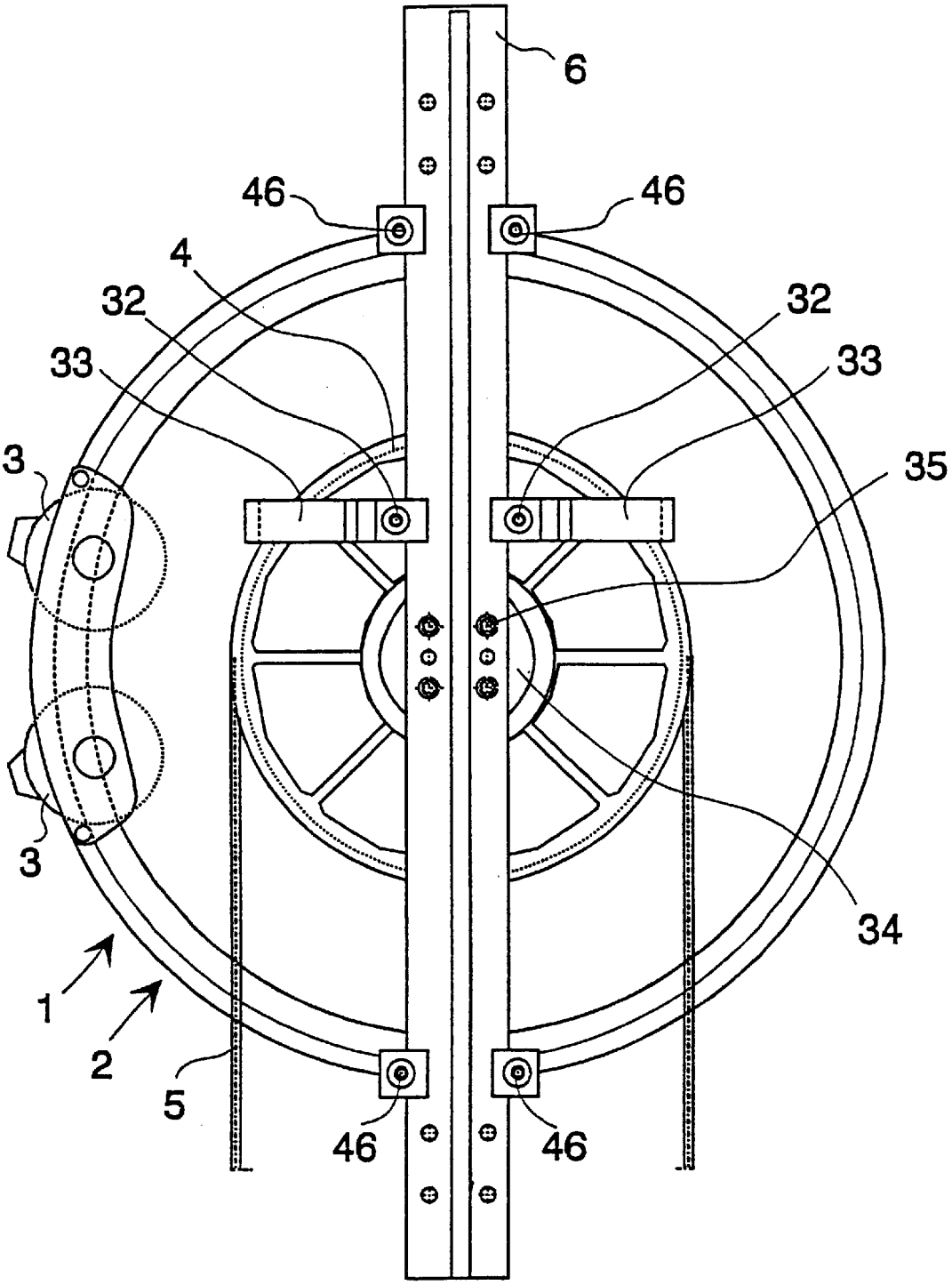
Fig. 1 PRIOR ART
FIG. 1 presents a prior-art hoisting machine.

FIG. 1 presents a hoisting machine 1 known from specification EP 0688735 A2, fixed to one guide rail 6. The guide rail may be either a car guide rail or a counterweight guide rail, and the hoisting machine may be placed in the upper part or in the lower part of the hoistway. The hoisting machine 1 comprises an elevator motor 2 of the discoid motor type. The elevator ropes 5 start out from the traction sheave 4. The hoisting machine is fixed to the guide rail 6 by means of claw-type clamps 46 gripping the edges of the hoisting machine. In addition, the hoisting machine is fastened to the guide rail by its central part by means of brackets 35 and a supporting element 34. Most of the vertical forces of the hoisting machine are transmitted by the supporting element 34. The claw-type clamps prevent the hoisting machine from being loosened from contact with the guide rail while also preventing the machine from turning. Attached to the guide rail 6 with holders 32 is a guard 33 to prevent the elevator ropes 5 from rising off the rope groove on the traction sheave 4.

Figure 3:
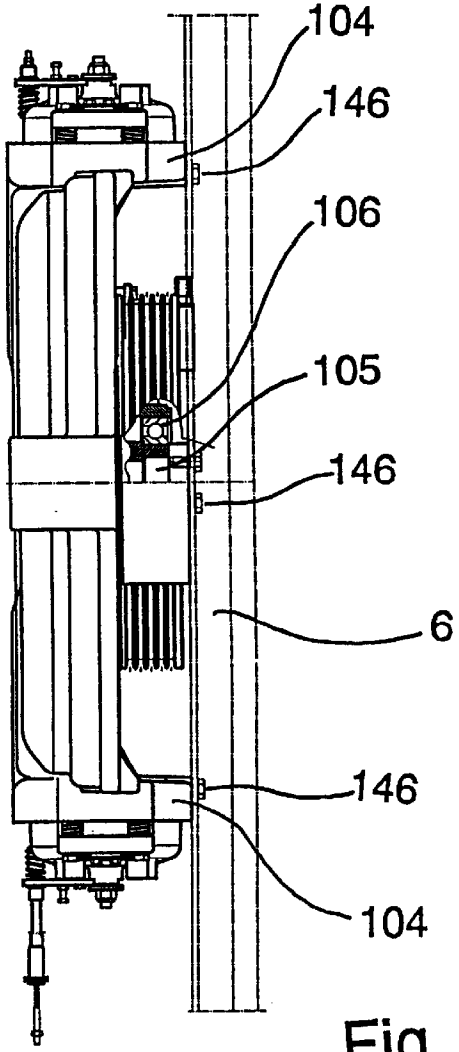
FIG. 3 presents a hoisting machine according to the invention in side view.
Figure 2:
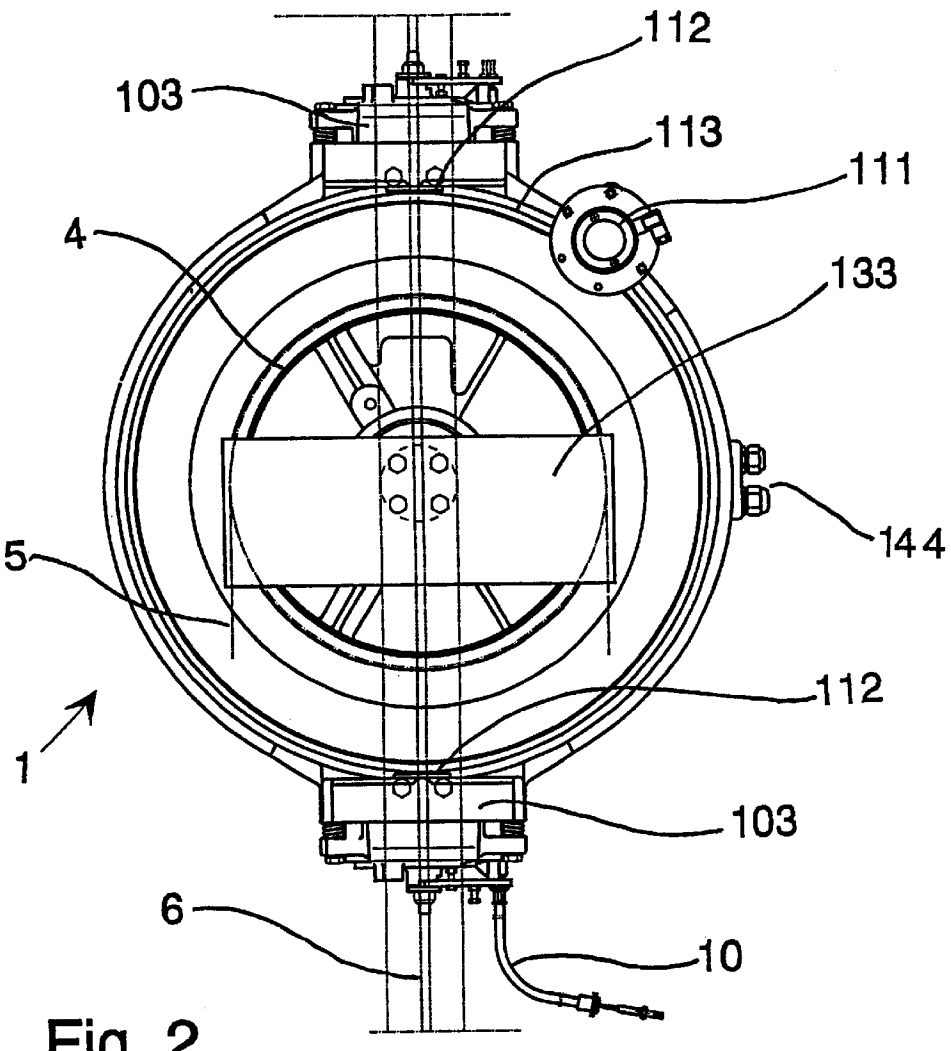
FIG. 2 presents a hoisting machine according to the invention in front view.

FIG. 2 presents a front view of a hoisting machine according to the invention, and FIG. 3 presents a side view of the machine in FIG. 2. The hoisting machine 1 is fixed to one guide rail 6. The guide rail may be either a car guide rail or a counterweight guide rail and the mounting position of the hoisting machine may be e.g. in the upper part or in the lower part of the hoistway. The hoisting machine is of a flat construction, in other words, the thickness of the hoisting machine is clearly smaller than its diameter. The thickness of the traction sheave hoisting machine is less than one third of the diameter of the machine, so the hoisting machine can be regarded as being of a very flat construction. The hoisting machine 1 comprises a flat elevator motor, two brakes 103 and a traction sheave 4. The hoisting machine 1 is preferably of a gearless type and the elevator motor is preferably a permanent magnet synchronous motor, e.g. an external rotor motor or a discoid motor. Other types of hoisting machine and elevator motor may also be used. For the supply of electricity to the motor of the hoisting machine, cable lead-through holes 144 are provided in the side of the machine. The elevator ropes 5 start out from the traction sheave 4. The brakes protrude upward and downward from the hoisting machine. Thus, the brakes form mass concentrations at the upper and lower ends of the wide machine frame. The brakes comprise brake pads 112 so fitted that they can be pressed against a braking surface 113 rotating with the traction sheave. When the brake pads are pressed against the braking surface, a force is generated in the hoisting machine frame that tends to stretch the frame. The hoisting machine is fastened to the elevator guide rail 6 by means of fixing devices 146 holding it by the edges of the hoisting machine frame and by the center of the hoisting machine. The guide rail 6 functions as a tension bar resisting vertical stretching of the hoisting machine as the brakes apply their force against the braking surface 113. Similarly, the guide rail 6 can act as a compression bar. Thus, the frame of the hoisting machine 1 is stiffened by the guide rail 6 in the direction in which the large masses of the brakes 103 are located at the edges and the natural frequency of the corresponding vibration rises. In addition to the guide rail, a tension bar fastened to two or more points on the machine frame may be used to increase the stiffness of the hoisting machine. The guide rail 6 being a so-called T-rail, the fixing devices may well consist of bolts fastening the machine to the back of the T-rail. For the bolts, holes have been drilled in the back of the T-rail. At the edges of the hoisting machine, the fixing bolts are placed in a part 104 of the frame formed as a mounting base for the operating brakes 103. The operating brakes 103 are electrically controlled brakes closed by a spring. The brakes are released and held in a released position by passing an electric current into an electromagnetic regulating unit provided in the brake. In the absence of electric control, the spring in the brake presses the brake shoe 112 against the braking surface 113. This part 104 of the frame also forms part of the brake housing. In the central part, the machine is fastened to the guide rail 6 via a supporting shaft going through the boss of the traction sheave 4. The supporting shaft 105 is fixed to the frame of the drive machine 1, and the traction sheave is supported on this shaft by a bearing 106. Thus, the traction sheave 4 is supported by the supporting shaft 105 whose one end is supported by the guide rail in the region of the boss of the traction sheave while its other end is supported by the frame of the hoisting machine fastened by its edges to the guide rail. The hoisting machine is provided with a jump guard 133 for preventing the elevator ropes 5 from rising off the rope groove on the traction sheave 4. In its simplest form, the jump guard is a metal plate which has been pressed into position between the guide rail and the machine in the region of the traction sheave boss and whose ends have been bent so that they cover the rope grooves on the sides of the traction sheave. A tachometer 111 is installed to monitor the motion of the part rotating with the traction sheave of the hoisting machine to give a feedback signal to the control system of the elevator motor. For emergency release of the brake there is a wire cable 10 by means of which the brakes 103 of the elevator machine can be released mechanically. Emergency brake release is needed when passengers are to be rescued from an elevator that has stopped between floors e.g. due to a power failure.

Figure 4:
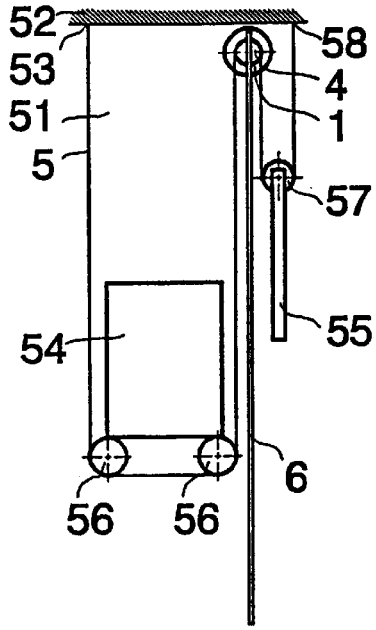
FIG. 4 presents a diagram illustrating a possible arrangement regarding the placement of the hoisting machine in the hoistway.
Figure 5:
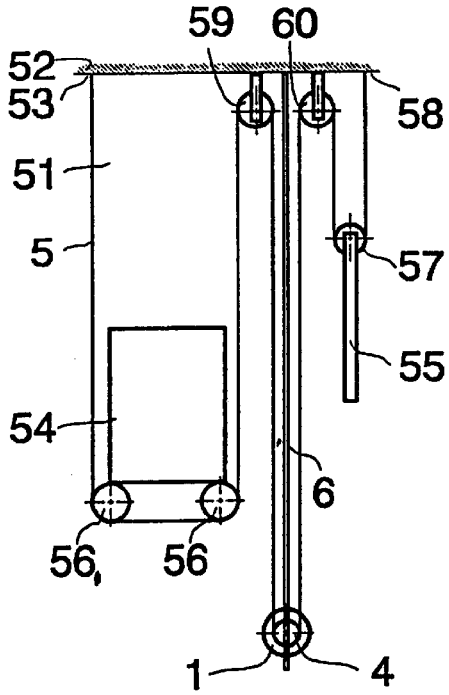
FIG. 5 presents a diagram illustrating another possible arrangement regarding the placement of the hoisting machine.

FIGS. 4 and 5 present diagrams illustrating two examples of how the hoisting machine 1 of the invention is placed on a guide rail 6 in a hoistway 51.

In FIG. 4, the hoisting machine is mounted at the upper end of a guide rail 6. The guide rail 6 may be a guide rail of either the elevator car 54 or the counterweight 55. One end of the elevator rope 5 is anchored to the upper part 52 of the hoistway 51 at point 53, from where the elevator rope is passed below the elevator car 54 via diverting pulleys 56 to the traction sheave 4 and further down via a diverting pulley 57 on the counter-weight 55 and back up, where the other end of the elevator rope is anchored to the upper part of the hoistway at point 58.

FIG. 5 presents another case where the hoisting machine 1 is mounted at the lower end of a guide rail 6 in the hoistway 51. One end of the elevator rope 5 is anchored to the upper part 52 of the hoistway 51 at point 53, from where the elevator rope is passed below the elevator car 54 via diverting pulleys 56 and via a diverting pulley 59 in the upper part of the hoistway 51 to the traction sheave 4 of the hoisting machine 1 fixed to the lower end of the guide rail. From there, the rope is passed up to another diverting pulley 60 and then downward via a diverting pulley 57 on the counterweight 55 and back up, where the other end of the elevator rope is anchored to point 58 in the upper part of the hoistway. The rope anchorage points 53, 58 in the upper part of the hoistway may be located in the ceiling or wall of the hoistway or in some other supporting structure. The other supporting structure for rope anchorage may be e.g. a separate support or one or more mounting bases supported by the upper ends of the guide rails.

In the foregoing, the invention has been described by way of example with reference to the attached drawings. It is obvious to the person skilled in the art that the embodiments of the invention are not restricted to the examples described above, but that they can be varied within the scope of the claims presented below.

What is claimed is:

1. A hoisting machine for an elevator, the hoisting machine being mounted on and fastened to one side of an elevator or counterweight guide rail, the hoisting machine comprising:

at least an elevator motor;

a traction sheave driving elevator ropes; and a plurality of operating brakes for the elevator, the hoisting machine being fastened to the guide rail at points in an immediate vicinity of the operating brakes, the points in the immediate vicinity of the operating brakes being points on the operating brakes.

2. The hoisting machine as defined in claim 1, wherein the plurality of operating brakes include operating brakes on each side of the hoisting machine and adjacent the guide rail.

3. The hoisting machine as defined in claim 1, wherein, the guide rail is used as a structural part of the hoisting machine.

4. The hoisting machine as defined in claim 1, wherein the traction sheave has a shaft which is fixed to the guide rail.

5. The hoisting machine as defined in claim 1, wherein the traction sheave has a bearing and wherein a frame of the hoisting machine is fastened to the guide rail through the bearing of the traction sheave and by upper and lower parts of the frame.

6. The hoisting machine as defined in claim 5, wherein the hoisting machine is provided with a tension bar between the upper and lower parts of the frame.

* * * * *